United States Patent [19]

Avery et al.

[11] 4,293,943

[45] Oct. 6, 1981

[54] WATCH STAND

[76] Inventors: Victor S. Avery, c/o George Spector, 3615 Woolworth Bldg.; George Spector, 3615 Woolworth Bldg., both of New York, N.Y. 10007

[21] Appl. No.: 48,718

[22] Filed: Jun. 15, 1979

[51] Int. Cl.[3] ..... G04B 37/00; A47F 7/00

[52] U.S. Cl. ..... 368/316; 248/116

[58] Field of Search ..... 58/56; 248/114–116; 368/316

[56] References Cited

U.S. PATENT DOCUMENTS 1,623,749 4/1927 Pelkey ..... 58/56

FOREIGN PATENT DOCUMENTS 980855 5/1951 France ..... 248/116

1024308 3/1953 France ..... 248/116

*Primary Examiner*—Gene Z. Rubinson

*Assistant Examiner*—John B. Conklin

[57] ABSTRACT

An improved watch stand so that a wrist watch can serve as a night table clock when not being worn on a wrist, the stand including a triangular base around which the watch band is fitted, the base in one design including a pad that is screw adjustable to bear against a rear of the watch case, and the base in another design being compressible by having one triangular side outwardly arged by an internal compression spring.

4 Claims, 7 Drawing Figures

WATCH STAND

This invention relates generally to time piece display stands.

It is well known that when a person takes off a wrist watch upon retiring in the evening, and places it on a table along with other removed articles such as keys, coins and wallet, the watch seems to be generally useless along with the other articles until a next day when the person gets dressed again.

It is a principal object of the present invention to convert a wrist watch, removed from a person's wrist for the night, into a night table clock so that it appears intended for use during such hours when a person has need for a night table clock.

Another object is to provide an improved watch stand around which a wrist watch attached on a watch band, can readily be mounted in a quick and easy manner.

Another object is to provide an improved watch stand which in one design includes an adjustable pad behind the watch case.

Another object is to provide an improved watch stand which in another design is compressible so that a wrist watch with an unstretchable band, such as of leather, will readily fit therearound without need to open up the band buckle.

Figure 1:
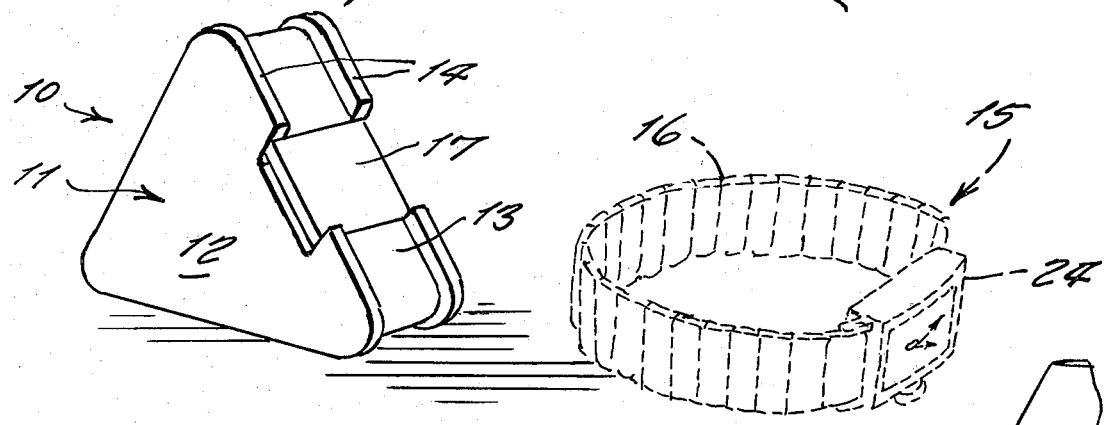
FIG. 1 is a perspective view of one design of the invention and which includes an adjustable pad for the watch case.
Figure 2:
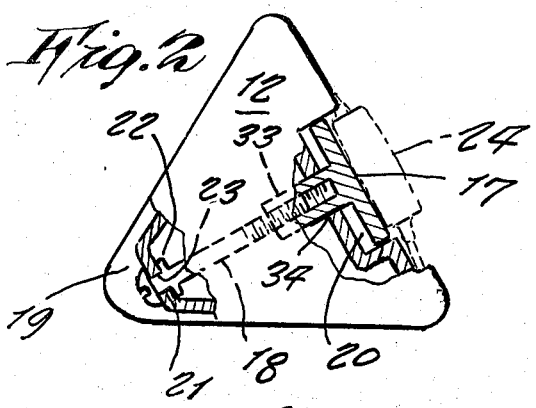
FIG. 2 is a side view thereof shown partly in cross section.
Figure 3:
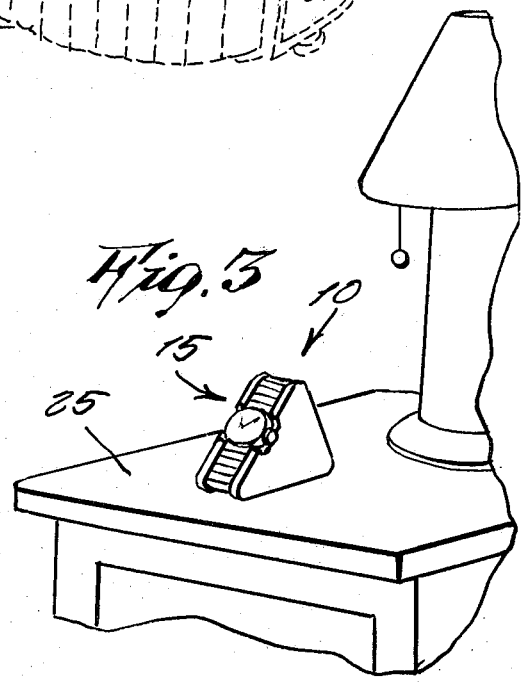
FIG. 3 illustrates the invention in use, fitted with a wrist watch so to serve as a table top clock when the watch is not worn such as at night.

Referring now to the drawing in greater detail, and more particularly to FIGS. 1 to 3 thereof at this time, the reference numeral 10 represents an improved watch stand, according to the present invention, wherein there is a triangular shaped base 11 which has two parallel, flat opposite sides 12 and three side edge faces 13. A raised bead 14 along the edges of faces 13 serve to prevent a wrist watch 15 to slide off the base, when the band 16 of the watch is fitted around the base. In the present invention, the beads are broken away along one of the edge faces so as to provide clearance for the watch case if the same is wide, and also for the purpose of clearing the winding knob of the watch, which is usually located along a side of the case. The face 13 between the broken away beads is inwardly recessed so that a pad 17 therein can be raised, lowered or kept flush with the face, as wished. The base comprises a hollow, hard plastic shell.

A screw 18 from a triangular corner 19 of the base engages a rear of the pad so as to slide the pad adjustably inwardly or outwardly of the recess 20. An annular groove 21 formed between the screw head and a flange 22 rotates in a hole 23 of the base shell preventing longitudinal travel of the screw.

In use, the wrist watch is simply fitted around the base, with the watch case 24 rested against the pad, and the base is then placed standing up on a night table 25, as shown in FIG. 3.

Figure 4:
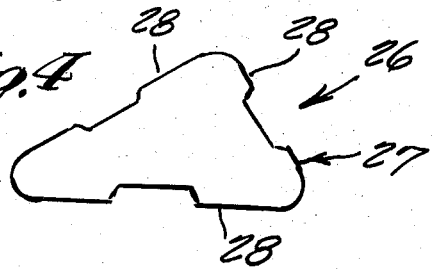
FIG. 4 is a side view of another design of the invention in which each of the three side edges can hold the wrist warch case at a different inclined angle, as preferred.

FIG. 4 shows another design 26 of the invention, wherein the base 27 is not equilateral triangular shaped like the base 11, by is shaped with each edge 28 thereof being a different length, each edge including the above described notched beads and the pad.

Thus in this design, the base can be stood up on any one of its three edges so to result in any of different inclined angles of edges against which the watch case rests, as wished.

Figure 5:
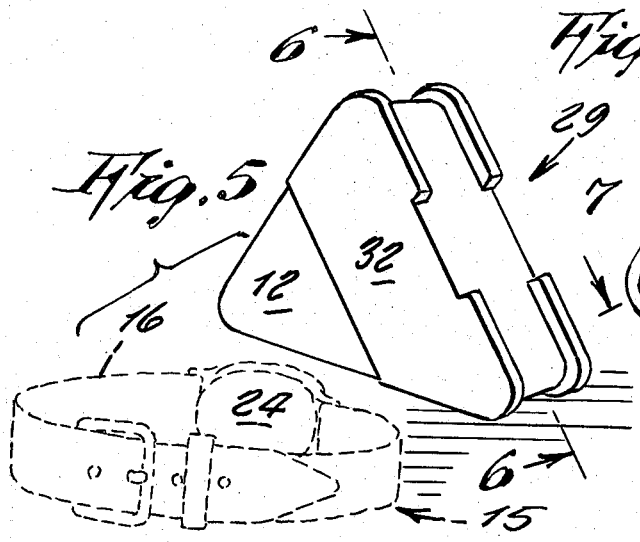
FIG. 5 is a perspective view of another design of the invention, made particularly for wrist watches having a leather strap that accordingly does not stretch.
Figure 6:
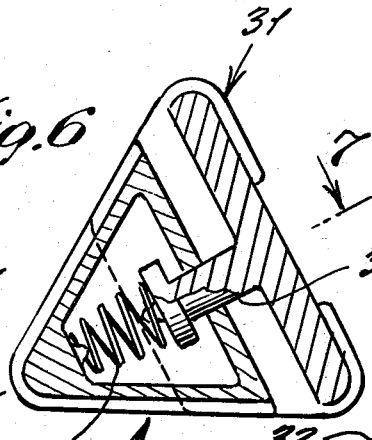
FIG. 6 is a cross sectional view on line 6—6 of FIG. 5, and showing how the watch stand can be compressed in size so the leather strapped wrist watch can be easily fit on it.
Figure 7:
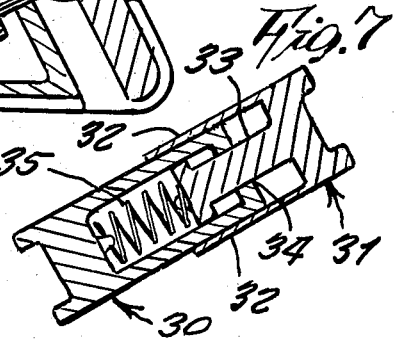
FIG. 7 is a cross sectional view on line 7—7 of FIG. 6.

In FIGS. 5 to 7, another triangular design 29 of the invention, includes a triangular base 30 and a pad 31 that extends a full length of one side edge of the design. The pad is made with a thin flange 32 along its opposite sides so that the base can fit between the flanges. The pad is made similarly to pad 17 by including a stem 33 formed on its rear which extends through a hole 34 in the base shell, so that the pad is thus slidable inwardly or outwardly relative to the base. In this design, a compression coil spring 35 inside the base normally urges the pad into outwardly position.

Thus in this design, the entire device is compressible in periphercal length a substantial amount, due to the pad including two corners of the triangular design. Accordingly, this form of the invention allows a wrist watch, fitted with a leather strap, to be easily mounted thereupon without need of unbuckling the strap.

What is claimed:

1. A watch stand, for supporting a wrist watch in a utility position on a table comprising a triangular shaped base having an encompassing outer surface between parallel triangular side surfaces in combination with a pad mounted on said outer surface said pad being slidable inwardly and outwardly of said surfaces to provide an adjustable outer support platform for said watch body said outer surface being adapted to support the wrist watch band including peripheral extensions beyond said outer surface to form a channel thereabout for the wristband.

2. The combination of claim 1 wherein the pad comprises an outer platform and an inner member slidably received in an internal recess in said base, said platform being adjustably mounted on said member.

3. The combination as set forth in claim 1 wherein a compression coil spring, inside said base, abutts at one end against said pad and abutts at its opposite end against an internal portion base, said pad having integral sides telescopically fitted over said side surfaces.

4. The combination of claim 2 wherein said inner member is threadedly connected to said platform and has manually adjustable means extending externally from said outer surface, said platform being slidably received in a guide recess formed in said sides and, having parallel spaced guide walls abutting said platform.

* * * * *